US007259523B2

(12) United States Patent
Veldman et al.

(10) Patent No.: US 7,259,523 B2
(45) Date of Patent: Aug. 21, 2007

(54) CIRCUIT ARRANGEMENT

(75) Inventors: Paul Robert Veldman, Oss (NL); Bernhard Christiaan Van Dijk, Oss (NL); Jianjun Yu, Shanghai (CN)

(73) Assignee: Koninklijke Philips Electronics N.V., Eindhoven (NL)

( * ) Notice: Subject to any disclaimer, the term of this patent is extended or adjusted under 35 U.S.C. 154(b) by 16 days.

(21) Appl. No.: 10/543,952

(22) PCT Filed: Jan. 14, 2004

(86) PCT No.: PCT/IB2004/050021

§ 371 (c)(1),
(2), (4) Date: Aug. 1, 2005

(87) PCT Pub. No.: WO2004/071136

PCT Pub. Date: Aug. 19, 2004

(65) Prior Publication Data

US 2006/0071612 A1 Apr. 6, 2006

(30) Foreign Application Priority Data

Feb. 4, 2003 (EP) ..... 03100226

(51) Int. Cl.
*G05F 1/00* (2006.01)

(52) U.S. Cl. ..... 315/291; 315/209 R; 315/224; 315/307; 315/290; 315/DIG. 5; 315/DIG. 7

(58) Field of Classification Search ..... 315/209 R, 315/289–291, 307, 244, 224, 194, 308, DIG. 5, 315/DIG. 7

See application file for complete search history.

(56) References Cited

U.S. PATENT DOCUMENTS

| | | | | |
|---|---|---|---|---|
| 4,535,399 | A * | 8/1985 | Szepesi | 363/41 |
| 5,717,295 | A * | 2/1998 | Nerone | 315/307 |
| 5,739,644 | A * | 4/1998 | Bernitz et al. | 315/289 |
| 6,002,214 | A | 12/1999 | Ribarich | |
| 6,008,592 | A | 12/1999 | Ribarich | |
| 6,020,689 | A * | 2/2000 | Gradzki et al. | 315/224 |
| 6,949,888 | B2 * | 9/2005 | Ribarich | 315/291 |

FOREIGN PATENT DOCUMENTS

EP 0806888 11/1997

* cited by examiner

*Primary Examiner*—Haissa Philogene

(57) ABSTRACT

In a bride circuit comprising a lamp choke that might partially saturate during the ignition of the lamp, at least one of the switches is switched off when the amount of charge displaced through it in forward direction equals a predetermined value. Despite the partial paturation of the lamp choke the amplitude of the ignition voltage is thereby effectively controlled.

10 Claims, 6 Drawing Sheets

CIRCUIT ARRANGEMENT

This application is a 371 of PCT/1B04/50021 field Jan. 14, 2004.

BACKGROUND OF THE INVENTION

The invention relates to a circuit arrangement for igniting and operating a lamp comprising

- input terminals for connection to a supply voltage source,
- a DC-AC-converter coupled to the input terminals and equipped with
  - a series arrangement comprising a first and a second switching element and connecting the input terminals,
  - a control circuit, coupled to respective control electrodes of the first switching element and the second switching element, for generating a periodic control signal for alternately rendering the first switching element and the second switching element conductive and non-conductive,
  - a load circuit shunting one of the switching elements and comprising a series arrangement of an inductive element and a first capacitive element.

Such a circuit arrangement is in common use, more in particular for the operation of fluorescent lamps. Generally, the fluorescent lamp is placed in parallel with the first capacitive element comprised in the load circuit. During the ignition of the lamp the frequency of the periodic control signal has a value for which the amplitude of the voltage across the capacitor (and thus across the lamp) is comparatively high to enable ignition of the lamp. As a consequence the amplitude of the current flowing through the series arrangement of the inductive element and the first capacitive element comprised in the load circuit is also comparatively high. This comparatively high amplitude of the current often causes the inductive element to saturate to a certain extent. In case the DC-AC-converter is a self-oscillating circuit, the control signal is often derived from the current through the inductive element. The conductive switching element is rendered non-conductive when the amplitude of the current through the inductive element reaches a predetermined value. Because this way of controlling the switches is generally comparatively fast, the (partly) saturating of the inductive element does not render the generation of the ignition voltage unstable.

In case the DC-AC-converter is not a self-oscillating circuit and the control signal is generated by means of a separate circuit part often comprising an integrated circuit, the ignition voltage is often generated by adjusting the frequency of the control signal at a predetermined value. In case no saturation of the inductive element takes place and the DC-AC-converter is operated inductively, a decrease in the frequency of the control signal corresponds to an increase in the amplitude of the ignition voltage. In case, however, saturation of the inductive element does take place, this saturation causes the inductance of the inductive element to decrease and therefore the resonance frequency of the load circuit to increase. As a result the saturation of the inductive element causes the relation between the frequency of the control signal and the amplitude of the ignition voltage to reverse. Consequently, in case the DC-AC-converter is not a self-oscillating circuit a dependable control of the amplitude of the ignition voltage by controlling the frequency of the control signal is often impossible, when saturation of the inductive element takes place. Some control circuits are equipped with means to measure the current through the conducting switching element or through the inductive element. Switching takes place when the amplitude of the measured current reaches a predetermined value. A disadvantage of this approach is that the switching element can only be rendered non-conductive before or ultimately at the maximal value of the amplitude of the current through the switching element or the inductive element. However, the slight saturation of the inductive element may cause a substantial amount of damping of the ignition voltage, this damping in turn necessitating the switching element to be rendered conductive only after the amplitude of the current through the switch or the inductive element has reached its maximal value. Consequently, switching when the measured current reaches a predetermined value does not result in a dependable control of the ignition voltage.

SUMMMARY OF THE INVENTION

Among other things, the invention aims to provide a circuit arrangement for igniting and operating a lamp in which the ignition voltage can be generated in a well controlled way.

A circuit arrangement as mentioned in the opening paragraph is therefor characterized in that the control circuit is equipped with

- a first signal generator coupled to one of the switching elements for generating a first signal that represents the integral of the current that has flowed in forward direction through the said switching element in the present period of the control signal,
- a second signal generator for generating a first reference signal that represents a desired value of the integral of the current in forward direction through the switching element, coupled to the first signal generator, in each period of the control signal,
- a switching circuit coupled to the first signal generator, to the second signal generator and to a control electrode of the switching element coupled to the first signal generator, for rendering the switching element non-conductive, when the first signal equals the first reference signal.

The first signal represents the integral of the current that has flowed in forward direction through the switching element that is coupled to the first signal generator, or in other words the amount of charge that has been displaced through the switching element. This amount of charge is a direct measure of the amount of energy that is fed from the supply voltage source into the resonant LC circuit formed by the inductive element and the first capacitive element comprised in the load circuit. The first and second signal generator together with the switching circuit ensure that the amount of energy supplied by the supply voltage is the same in successive half cycles during which the switching element, that the first signal generator is coupled to, is conductive. As a consequence the amplitude of the ignition voltage is the same in successive cycles of the control signal in spite of some saturation of the inductive element taking place. It be mentioned that the invention allows an effective control of the ignition voltage not only in circuit arrangements in which the inductive element partly saturates but also in any other circuit arrangement as described in the opening paragraph. More in particular, when damping takes place without saturation of the inductive element or when it is desirable that the amplitude of the ignition voltage is independent of temperature, the invention can be applied to obtain an effective control of the ignition voltage.

It has been found that a satisfactory control of the amplitude of the ignition voltage can be achieved by controlling only the amount of charge transported through only one of the switching elements. It is thus possible but unnecessary to control the amount of charge transported through each of the switches.

In a first preferred embodiment of a circuit arrangement according to the present invention, the first signal generator comprises

- an impedance in series with the switching element that the first signal generator is coupled to,
- a third signal generator for generating a second reference signal,
- an integrator having a first input terminal coupled to the impedance and a second input terminal coupled to an output of the third signal generator for integrating the voltage difference between the first and second input terminal while this voltage difference is positive.

It has been found that the implementation of the first signal generator in this referred embodiment allows a comparatively easy and dependable generation of the first signal. It is possible to choose the second reference signal so that the voltage difference between the first and second input terminal of the integrator equals the voltage across the impedance. Alternatively a very simple embodiment of the first signal generator can be realized in case the third signal generator comprises a diode and a second capacitive element and the integrator comprises an ohmic resistor and the second capacitive element. Good results have been obtained in case the integrator comprises a transductance amplifier, equipped with two input terminals and an output terminal, for generating an output current proportional to the voltage difference between its input terminals and comprises a second capacitive element coupled to the output terminal of the transductance amplifier. The transductance amplifier can be formed in an integrated circuit in a simple and dependable way making use of two current mirrors and an ohmic resistor.

Good results have been obtained for embodiments of a circuit arrangement according to the invention, in which the control circuit further comprises a timing circuit coupled to the switching circuit for rendering the switching element coupled to the first signal generator non-conductive after it has been conductive during a predetermined time interval. During ignition the switching element is rendered non-conductive when the first signal equals the second signal. The predetermined time interval is chosen longer than the time lapse needed in the ignition phase for the first signal to become equal to the first reference signal. In other words during the ignition phase the timing circuit does not control the moment in time at which the switching element is rendered non-conductive. During ignition this is controlled by the first and second signal generators. However, after ignition during stationary lamp operation the amplitude of the current through the switching element is much lower than during ignition. As a consequence the first signal does not become equal to the first reference signal before the timing circuit has timed the predetermined time interval. In other words, during stationary operation the rendering non-conductive of the switching element is controlled by the timing circuit. Good results have been obtained in case the timing circuit comprised a current source and a timing capacitor. In case the circuit arrangement comprises a second capacitive element, the timing capacitor is preferably formed by the second capacitive element. In case the first signal generator comprises an impedance in series with the switching element that it is coupled to, and comprises a third signal generator and an integrator, and the timing capacitor is formed by the second capacitive element, it is advantageous if the voltage difference between the first and second input terminal of the integrator equals the voltage across the impedance minus the second reference voltage.

BRIEF DESCRIPTION OF THE DRAWING

Embodiments of a circuit arrangement according to the invention will be discussed in more detail making reference to a drawing. In the drawing

DESCRIPTION OF THE PREFERRED EMBODIMENTS

Figure 1:
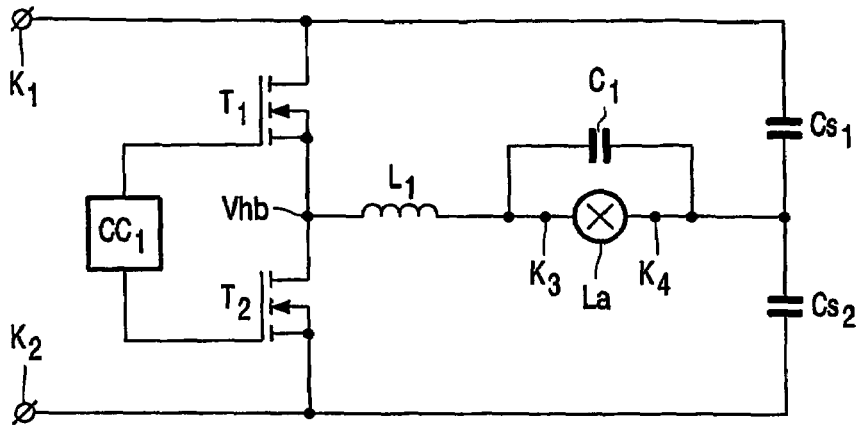
FIG. 1 shows an embodiment of a circuit arrangement according to the invention.

In FIG. 1, K1 and K2 are input terminals for connection to a supply voltage source. Input terminals K1 and K2 are connected by means of a series arrangement of a first switching element T1 and a second switching element T2. Circuit part CC1 is a control circuit for generating a periodic control signal for alternately rendering the first switching element T1 and the second switching element T2 conductive and non-conductive. Respective output terminals of circuit part CC1 are thereto coupled with respective control electrodes of the first and second switching element. Second switching element T2 is shunted by a series arrangement of an inductive element L1, a first capacitive element C1 and a capacitive element Cs2. A lamp La is connected in parallel to the first capacitive element C1 by means of lamp connection terminals K3 and K4. Inductive element L1, first capacitive element C1, capacitive element Cs2, lamp connection terminals K3 and K4 and the lamp La together form a load circuit. A common terminal of first capacitive element C1 and capacitive element Cs2 is connected to input terminal K1 by means of a capacitive element Cs1.

The operation of the circuit arrangement shown in FIG. 1 is as follows.

When input terminals K1 and K2 are connected to a supply voltage source supplying a DC supply voltage, the control circuit CC1 generates a periodic control signal that renders the first switching element T1 and the second switching element T2 alternately conductive and non-conductive. As a consequence a square wave shaped voltage Vhb is present at a common terminal of the two switching elements. The frequency f of this square wave shaped voltage equals the frequency of the periodic control signal. An alternating current, also with frequency f, flows through the load circuit When the lamp is not yet ignited the frequency f of the control signal is chosen so that the amplitude of the alternating current through the load circuit is comparatively high. As a consequence the amplitude of the voltage over the first capacitive element C1 (and thus the lamp La) is also comparatively high so that the lamp La will generally ignite within a comparatively short time interval. However, the comparatively high amplitude of the current through the load circuit also might cause the inductive element L1 to partly saturate so that the amplitude of the voltage across the first capacitive element (in other words the amplitude of the ignition voltage) cannot be controlled by means of adjusting the frequency of the control signal. How the amplitude of the ignition voltage is controlled will be discussed below referring to FIGS. 2-6. After the lamp has ignited, the circuit part CC1 changes the frequency of the control signal to a frequency suitable for stationarily operating the lamp La. During stationary operation an alternating current with this latter frequency flows through the load circuit and (partly) through the lamp La.

Figure 2:
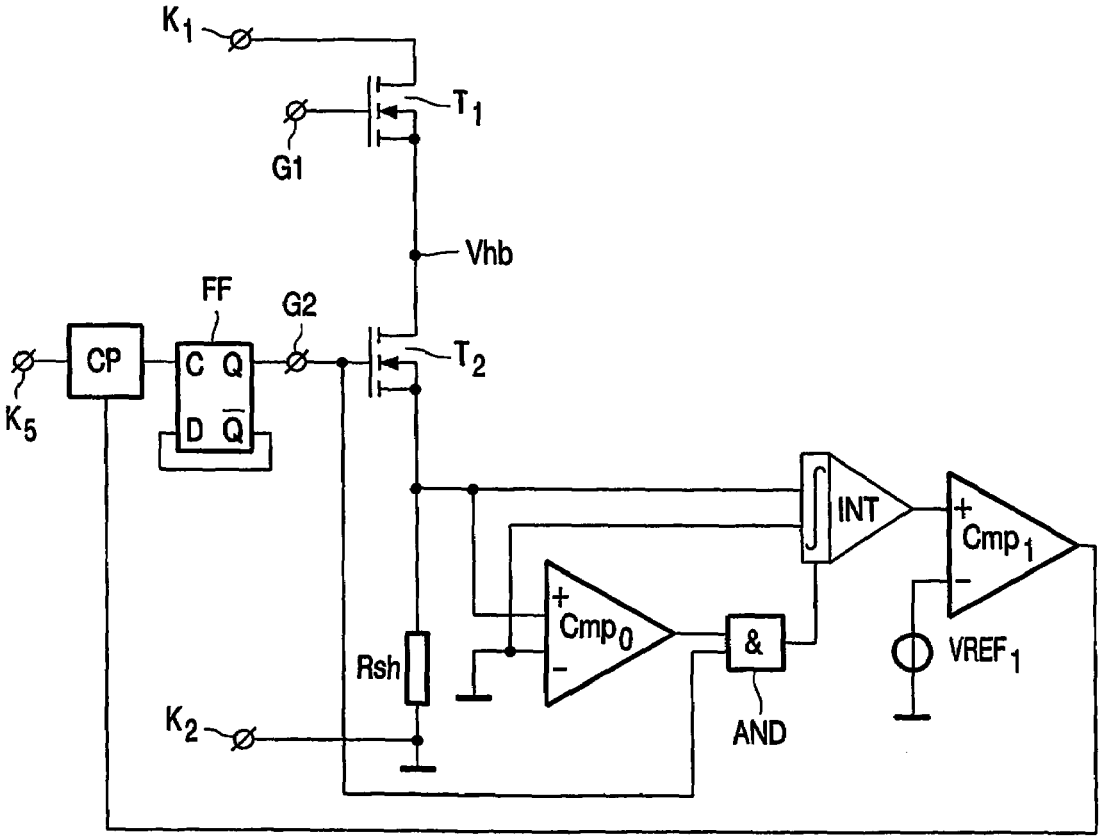
FIGS. 2-5 show alternative implementations of part of a control circuit comprised in the embodiment shown in FIG. 1.

Reference is now made to FIG. 2. FIG. 2 shows a part of the control circuit, more in particular the part that controls the time interval during which the second switching element is conductive during the ignition of the lamp La. FIG. 2 further shows the input terminals K1 and K2 and the first switching element T1 and the second switching element T2. An ohmic resistor Rsh is connected between second switching element 12 and input terminal K2. A common terminal of ohmic resistor Rsh and second switching element T2 is connected to a first input terminal of comparator Cmp0 and to a first input terminal of integrator INT. A second input terminal of integrator INT is connected to input terminal K2. A second input terminal of comparator Cmp0 is also connected to input terminal K2. An output terminal of comparator Cmp0 is connected to a first input terminal of and-gate AND. A second input terminal of and-gate AND is connected to the control electrode of second switching element T2. An output terminal of and-gate AND is connected to a reset input terminal of integrator INT. An output terminal of integrator ENT is connected to a first input terminal of comparator Cmp1. A second input terminal of comparator Cmp1 is connected to an output terminal of reference voltage source Vref1. An output terminal of comparator Cmp1 is connected to a first input terminal of circuit part CP. A second input terminal of circuit part CP is connected to a terminal K5. An output terminal of circuit part CP is connected to an input terminal of circuit part FF. Circuit part CP is a circuit part for generating a voltage pulse at its output terminal, when the voltage present at one of its input terminals changes from low to high. Circuit part FF comprises is a flipflop of the D-type and has a first and a second output terminal that are complementary: in case the voltage at one of the output terminals is low, the voltage at the other output terminal is high and vice versa. The flip-flop is connected in such a way that upon receiving a pulse at its input terminal the voltage at each of the output terminals changes from high to low or from low to high. The terminal K5 is connected to circuitry not shown in FIG. 2 for rendering the second switching element T2 conductive. The first output terminal of the circuit part FF is connected to the control electrode of second switching element T2. Ohmic resistor Rsh, comparator Cmp0, and-gate AND and integrator INT together form a first signal generator coupled to the second switching element T2. Ohmic resistor Rsh forms an impedance in series with second switching element T2. Input terminal K2 in this embodiment forms a third signal generator for generating a second reference signal. Integrator INT together with comparator Cmp0 and and-gate AND forms an integrator having a first input terminal coupled to the impedance Rsh and a second input terminal coupled to an output of the third signal generator for integrating the voltage difference between the first and second input terminal while this voltage difference is positive. Reference voltage generator Vref1 forms a second signal generator for generating a first reference signal that represents a desired value of the integral of the current in forward direction through the second switching element in each period of the control signal. The comparator Cmp1 together with circuit parts CP and FF form a switching circuit coupled to the first signal generator, the second signal generator and to the control electrode of the second switching element to switch off the second switching element when the first signal equals the second signal.

The operation of the circuitry shown in FIG. 2 is as follows.

When the second switching element T2 has been rendered conductive by the control signal and is actually carrying a current in forward direction so that the voltage drop over ohmic resistor Rsh is positive, the integrator INT is enabled by means of comparator Cmp0 and and-gate AND. At the output terminal of the integrator INT a voltage is present that forms a first signal representing the integral of the current that has flowed in forward direction through the second switching element T2 in that period of the control signal. When this first signal has become equal to the first reference signal, the voltage at the output terminal of comparator Cmp1 changes and the second switching element T2 is rendered non-conductive via circuit parts CP and FF. The integrator INT is reset by means of comparator Cmp0 and and-gate AND. During the first half of the next period of the control signal, the first switching element T1 is rendered conductive by means of circuitry that is not shown in FIG. 2. During the second half of the next period of the control signal, the second switching element T2 is rendered subsequently conductive and non-conductive as described hereabove.

Figure 3:
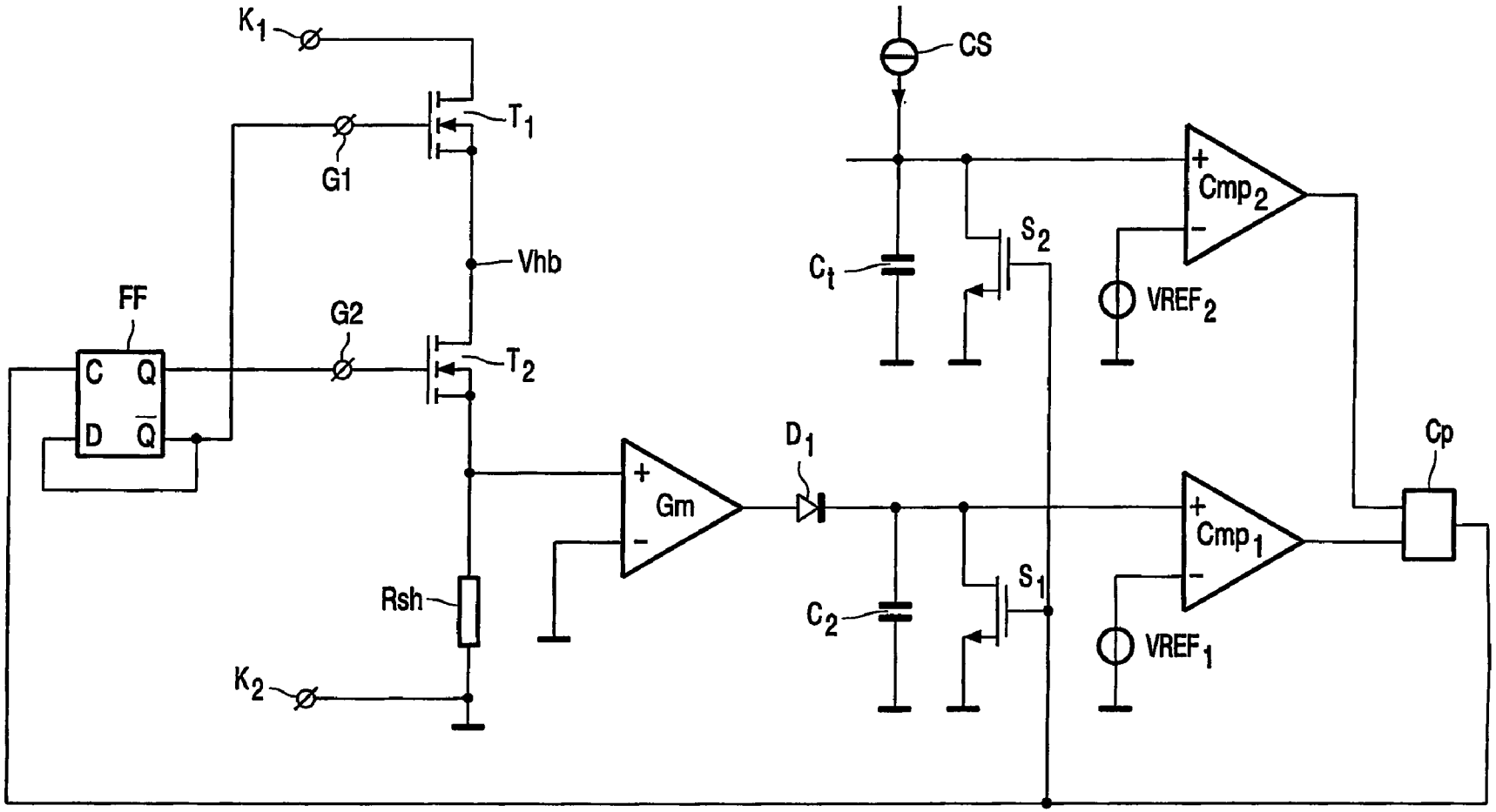

The circuitry shown in FIG. 3 comprises a first signal generator, second signal generator and a switching circuit like the circuitry shown in FIG. 2. The circuitry shown in FIG. 3 is additionally equipped with a timing circuit. In FIG. 3 circuit parts and components that are similar to circuit parts and components in the circuitry shown in FIG. 2 have been labeled with the same reference numbers. FIG. 3 further shows the input terminals K1 and K2 and the first switching element T1 and the second switching element T2. An ohmic resistor Rsh is connected between second switching element T2 and input terminal K2. A common terminal of ohmic resistor Rsh and second switching element T2 is connected to a first input terminal of a transductance amplifier Gm. A second input terminal of the transductance amplifier is connected to input terminal K2. Input terminal K2 in this embodiment forms a third signal generator for generating a second reference signal. An output terminal of the transductance amplifier Gm is connected to input terminal K2 by means of a series arrangement of a diode D1 and a capacitor C2. Capacitor C2 is shunted by a switching element S1. A common terminal of diode D1 and capacitor C2 is connected to a first input terminal of a comparator Cmp1. A second input terminal of comparator Cmp1 is connected to an output of reference voltage source Vref1. An output terminal of comparator Cmp1 is connected to a first input terminal of circuit part CP. As in the circuitry shown in FIG. 2, circuit part CP is a circuit part for generating a voltage pulse at its output terminal, when the voltage present at one of its input terminals changes from low to high. A second input terminal of circuit part CP is connected to an output terminal of comparator Cmp2. A timing capacitor Ct is connected between a first input terminal of comparator Cmp2 and input terminal K2. An output terminal of a current source CS is connected to the first input terminal of the comparator Cmp2. A second input terminal of comparator Cmp2 is connected to a reference voltage source Vref2. Timing capacitor Ct is shunted by a switching element S2. An output terminal of circuit part CP is connected to respective control electrodes of the switching elements S1 and S2 and to a an input terminal of circuit part FF that is similar to the circuit part FF in the circuitry shown in FIG. 2. A first output terminal of circuit part FF is coupled to a control electrode of the second switching element T1. A second output terminal of circuit part FF is coupled to a control electrode of the first switching element T1. Ohmic resistor Rsh, transductance amplifier Gm, diode D1 and capacitor C2 together form a first signal generator for generating a first signal that represents the integral of the current that has flowed in forward direction through the second switching element. Capacitor C2 forms a second capacitive element. Ohmic resistor Rsh forms an impedance in series with the switching element that the first signal generator is coupled to, which is the second switching element T2 in this embodiment. Reference voltage source Vref1 is a second signal generator for generating a first reference signal that represents a desired value of the integral of the current in forward direction through the second switching element in each period of the control signal. Comparator Cmp1, circuit part CP and circuit part FF together form a switching circuit coupled to the first signal generator, to the second signal generator and to the control electrode of the second switching element T2 for rendering the second switching element T2 non-conductive, when the first signal equals the first reference signal. Current source CS, timing capacitor Ct, comparator Cmp2 and reference voltage source Vref2 together form a timing circuit coupled to the switching circuit for rendering the switching element coupled to the first signal generator (i.e. the second switching element T2) non-conductive after it has been conductive during a predetermined time interval. In this embodiment the timing circuit can render both the first switching element T1 and the second switching element T2 conductive and non-conductive.

The operation of the circuitry shown in FIG. 3 is as follows.

When the circuit part CP generates a pulse that renders the second switching element conductive via circuit part FF, the first switching element is rendered non-conductive via the second output terminal of circuit part FF. The pulse generated by the circuit part CP also renders the switching elements S1 and S2 conductive during a short time lapse so that the voltages present across the capacitors C2 and Ct become substantially equal to zero. While second switching element T2 is conductive, the voltage over the ohmic resistor Rsh represents the momentary amplitude of the current through the second switching element T2. The transductance amplifier Gm generates an output current that is proportional to the voltage over the ohmic resistor Rsh and this output current charges capacitor C2. Diode D1 makes sure that the capacitor C2 is not discharged when the current through ohmic resistor Rsh does not flow in the forward direction. The voltage across capacitor C2 is the first signal. This first signal increases until it equals the first reference signal generated by the reference voltage source Vref1. While capacitor C2 is charged by the output current of the transductance amplifier Gm, capacitor Ct is charged by current source CS until the voltage across capacitor Ct equals the reference voltage generated by the reference source Vref2. This latter reference voltage represents a predetermined time interval. In case the lamp comprised in the load circuit (FIG. 1) has not yet ignited, the current through ohmic resistor Rsh has a comparatively high amplitude and for that reason the first signal will become equal to the first reference signal before the voltage across capacitor Ct equals the reference voltage generated by the reference voltage source Vref2. When the first signal has become equal to the first reference signal, the voltage at the output terminal of comparator Cmp1 changes from low to high and the second switching element is rendered non-conductive via circuit part CP and the first output terminal of circuit part FF. The first switching element T1 is rendered conductive via the second output terminal of circuit part FF and the capacitors C2 and Ct are discharged by means of a pulse generated by the circuit part CP and the switching elements S1 and S2. Since the second switching element T2 is non-conductive the voltage over ohmic resistor Rsh is substantially zero and capacitor C2 is not charged. Capacitor Ct, however, is charged by the current source CS to the reference voltage generated by reference voltage source Vref2. When the voltage across capacitor Ct equals the reference voltage generated by reference voltage source Vref2, the voltage at the output terminal of comparator Cmp2 changes from low to high and the first switching element T1 is rendered non-conductive via circuit parts CP and FF. Similarly the second switching element is rendered conductive via circuit parts CP and FF. Additionally capacitors C2 and Ct are discharged via circuit part CP and switching elements S1 and S2. The operation of the circuitry as described hereabove is then repeated. It is noteworthy that the time interval during which the second switching element T2 is maintained conductive corresponds to a desired value of the integral of the current or in other words of the amount charge displaced in forward direction through the second switching element. The time interval during which the first switching element T1 is maintained conductive, however, is determined by the timing circuit. In other words the conduction times of the two switching elements can be substantially different. It has been found, however, that controlling only the amount of charge displaced through one of the switching elements is in practice sufficient to obtain an effective control of the amplitude of the ignition voltage.

When the lamp comprised in the load circuit has ignited, the current through the load circuit and therefor through each of the switching elements is much lower than during ignition. As a consequence, when the second switching element is conductive, the voltage over the ohmic resistor Rsh is comparatively low and capacitor C2 is only charged comparatively slowly. Therefor, after ignition of the lamp, the voltage across capacitor Ct becomes equal to the reference voltage generated by the reference voltage source Vref2 before the first signal becomes equal to the first reference signal. The conduction times of both switching elements T1 and T2 are equal and are determined by the timing circuit and not by the first and second signal generator.

These conduction times and thereby the frequency of the control signal can be adjusted by adjusting the amplitude of the current supplied by the current source or the magnitude of the reference voltage generated by the reference voltage source Vref2.

Figure 4A:
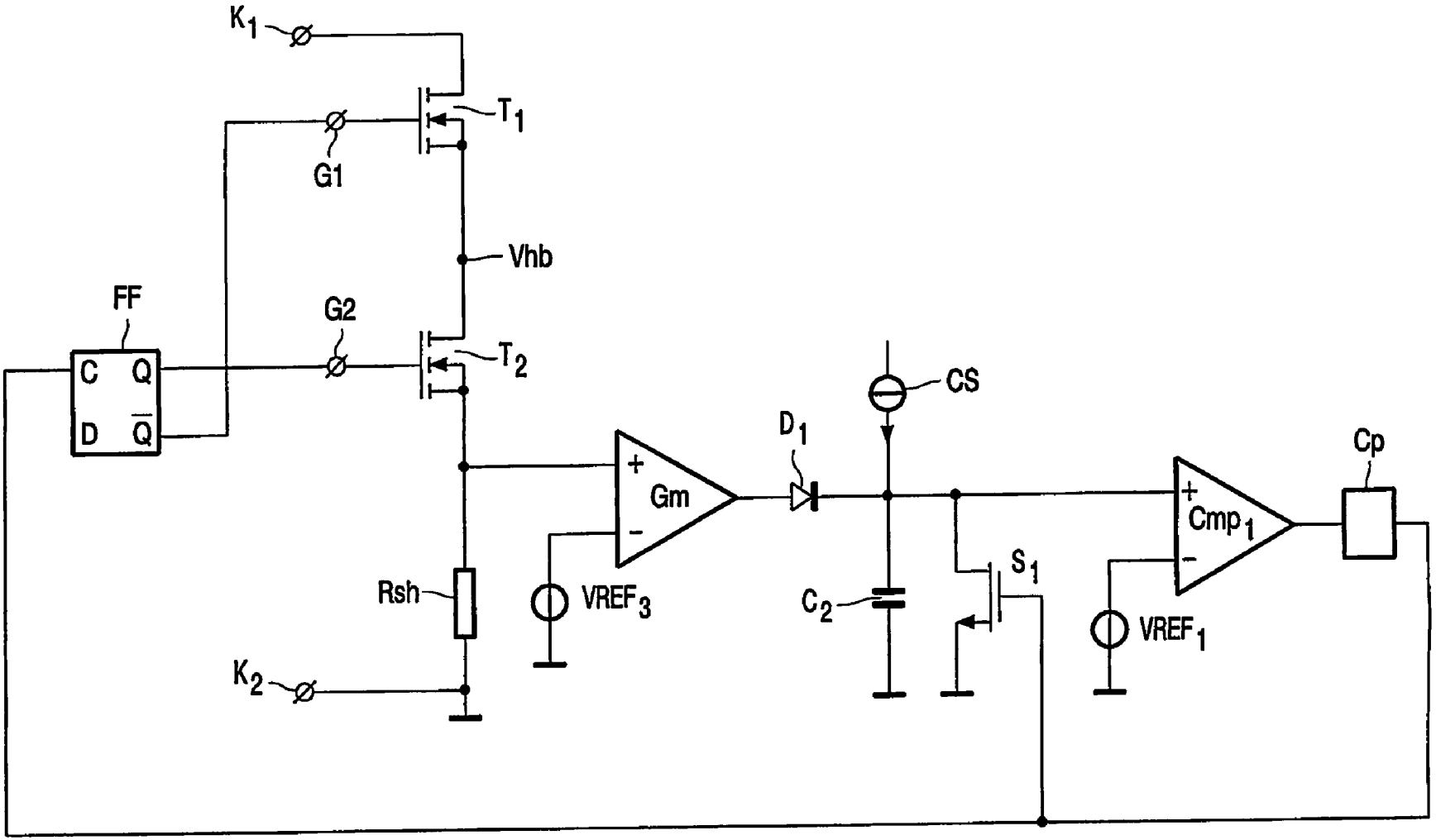

The circuitry shown in FIG. 4*a* functions in a way that is very similar to the functioning of the circuitry shown in FIG. 3. However, the circuitry shown in FIG. 4 comprises less components and circuit parts than does the circuitry shown in FIG. 3. Components and circuit parts that are similar to the components and circuit parts shown in FIGS. 2 and 3 are labeled with the same reference numbers. The circuitry shown in FIG. 4*a* differs from the circuitry shown in FIG. 3 in that capacitor Ct, switching element S2, comparator Cmp2, reference voltage source Vref2 are dispensed with. The output terminal of current source CS is connected to a common terminal of diode D1 and capacitor C2. In the circuitry shown in FIG. 2 and FIG. 3 the second reference signal is equal to the voltage present at input terminal K2.

In the circuitry shown in FIG. 4*a*, the second input terminal of the transductance amplifier is connected with the output terminal of a third signal generator for generating a second reference signal that differs from the voltage present at input terminal K2. In the circuitry shown FIG. 4*a*, the first signal generator is formed by the ohmic resistor Rsh, the transductance amplifier Gm, the third signal generator Vref3, diode D1 and capacitor C2. Current source CS, capacitor C2 and second signal generator Vref1 together form a timing circuit. Comparator Cmp1 and circuit part FF together form a switching circuit.

The circuitry shown in FIG. 4*a* operates as follows.

Figure 6:
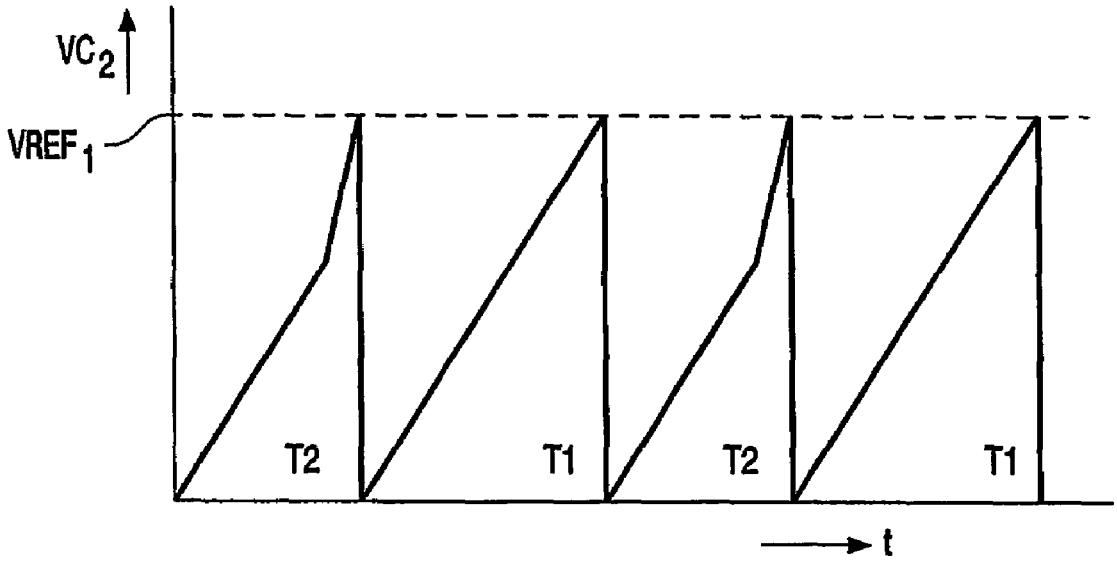
FIG. 6 shows the shape of the voltage over a capacitor comprised in the implementations shown in FIG. 4 and FIG. 5 as a function of time.

When the second switching element T2 is conductive and the first switching element T1 is non-conductive, a voltage differing from zero is present over ohmic resistor Rsh. As long as the voltage across the ohmic resistor Rsh is smaller than the second reference signal, the output current of the transductance amplifier is substantially zero and capacitor C2 is only charged by current source CS. When the lamp has not yet ignited, the current through the second switching element T2 will increase to a value for which the voltage across the ohmic resistor Rsh is higher than the second reference signal before the voltage over capacitor C2 equals the first reference signal. When the voltage across the ohmic resistor Rsh is higher than the second reference signal, the transductance amplifier will generate an output current that is proportional to the voltage difference between the voltage across Rsh and the second reference signal. Both this output current as well as the current supplied by the current source CS now charge capacitor C2. The circuitry is so designed that the amount of charge displaced through the second switching element T2 equals a desired amount to control the amplitude of the ignition voltage, when the voltage across capacitor C2 (the first signal) has become equal to the first reference voltage. It is note worthy that in the circuitry shown in FIG. 4*a* the first signal is not proportional to the integral of the current in forward direction through the second switching element as is the case in the circuitry shown in FIG. 2 and FIG. 3. However, also in the circuitry shown in FIG. 4*a* an unambiguous relation exists between the voltage across capacitor C2 and the integral of the current through the second switching element in forward direction, so that the voltage across capacitor C2 can be said to represent the integral of the current. When the voltage across the capacitor C2 has become equal to the first reference voltage, the second switching element T2 is rendered non-conductive and the first switching element T1 is rendered conductive via circuit parts CP and FF. Additionally, capacitor C2 is discharged via circuit part CP and switching element S1. When the first switching element T1 is conductive, the voltage across the ohmic resistor Rsh does not increase to a value higher than the second reference voltage, so that capacitor C2 is only charged by current source CS. As a result the conduction time of the first switching element T1 will be longer than the conduction time of the second switching element T2, as is also the case for the circuitry shown in FIG. 3. When the voltage over capacitor C2 equals the first reference signal, the first switching element is rendered non-conductive, the second switching element is rendered conductive, capacitor C2 is discharged via circuit part CP and switching element S1, and the operation cycle described hereabove is repeated. The shape of the voltage across capacitor C2 as a function of time is shown in FIG. 6. It can be seen that the charging of capacitor C2 becomes faster when the voltage over ohmic resistor Rsh has become bigger than the second reference voltage during the conduction of the second switching element T2. During the conduction of the first switching element T1 the capacitor is only charged by the current source, so that is taking place at the same rate during the complete conduction time of the first switching element T1.

Once the lamp has ignited, the current in the load circuit and therefore also the voltage across ohmic resistor Rsh becomes smaller, when the second switching element T2 is conductive. The circuitry is preferably so designed that after ignition of the lamp the voltage over ohmic resistor Rsh never becomes higher than the second reference voltage, so that the conduction time of both the first switching element T1 and the second switching element T2 are determined by the timing circuit only.

Figure 4B:
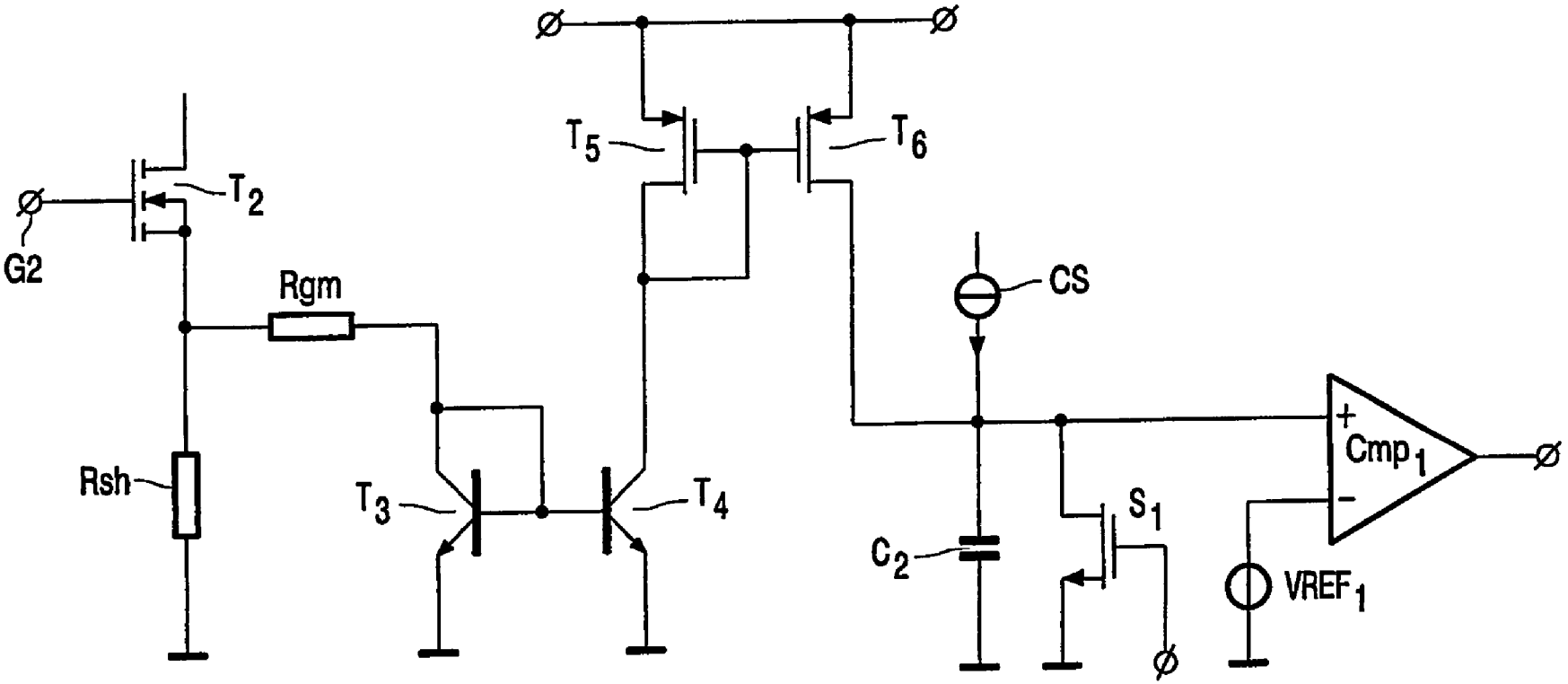

In FIG. 4*b* part of the circuitry shown in FIG. 4*a* is shown in which the transductance amplifier is implemented by means of two current mirrors formed by transistors T3, T4, T5 and T6 and an ohmic resistor Rgm. Additionally the third signal generator is formed by the base electrodes and the emitter electrodes of transistors T3 and T4. The second reference voltage is thus the base-emitter voltage of these transistors. The ohmic resistance of Rgm is high with respect to that of Rsh.

Figure 5:
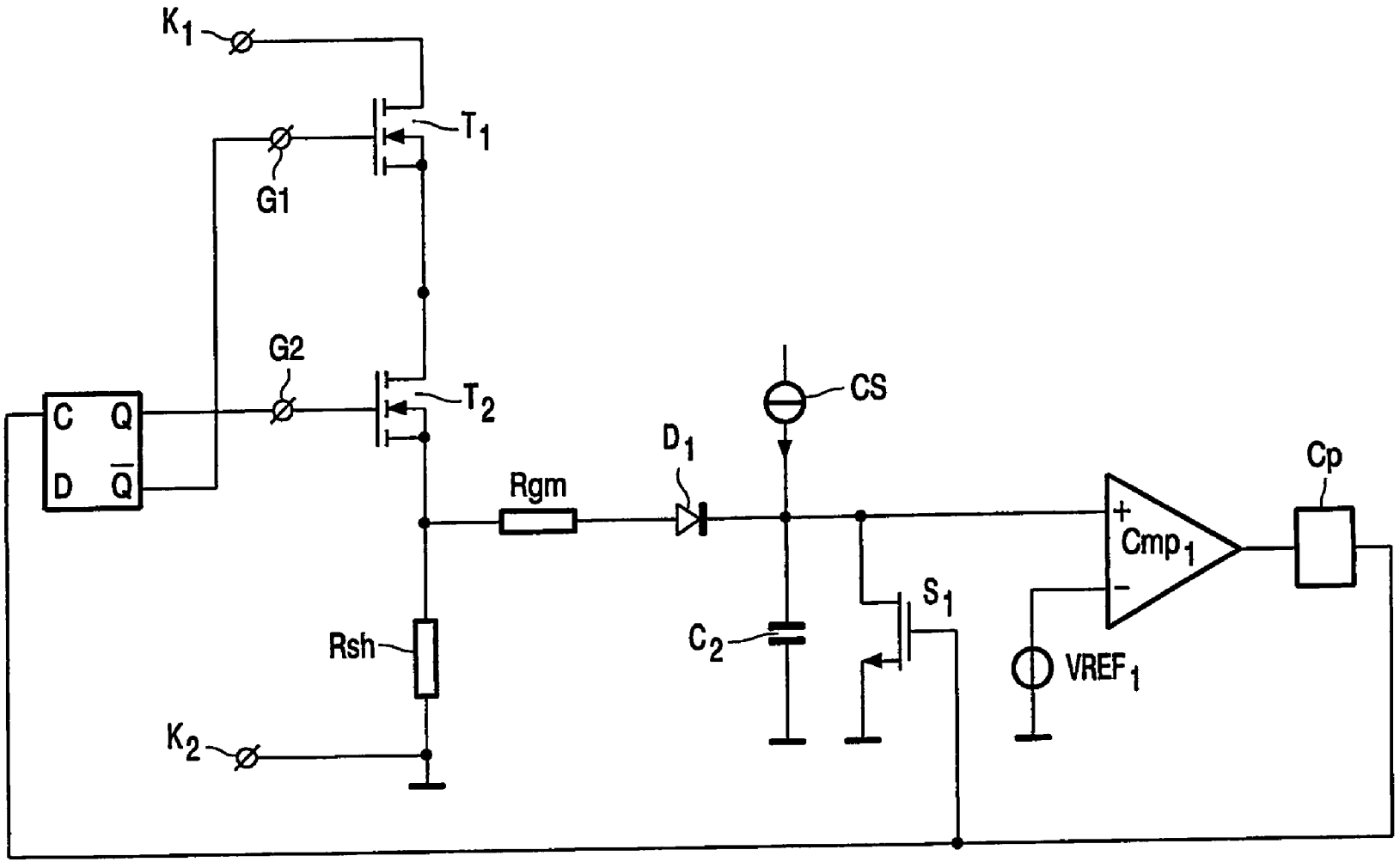

The circuitry shown in FIG. 5 differs from the circuitry shown in FIG. 4*a* in that the transductance amplifier together with the reference voltage source Vref3 have been replaced by an ohmic resistor. In this implementation the diode D1 together with capacitor C2 forms a third signal generator. The second reference signal generated by this third signal generator is not a constant signal but is a signal that increases during each half period of the control signal. Ohmic resistor Rgm together with capacitor C2 forms an integrator The input terminals of the integrator are a common terminal of ohmic resistors Rgm and Rsh and a common terminal of ohmic resistor Rgm and diode D1.

Although much simpler and therefore cheaper than the circuitry shown in FIG. 4, the circuitry shown in FIG. 5 has been found to perform satisfactorily. Since its operation is very similar to the operation of the circuitry shown in FIG. 4*a* its operation will not be described in detail.

It is noted that in the control of the conductive state of the first switching element T1 and the second switching element T2 it is necessary to make sure that these switching elements are never conductive at the same time so that a short circuit of the supply voltage is avoided. This is in practice done by making use of delay means that ensure that the conductive switching element is always rendered non-conductive before the other switching element is rendered conductive. These delay means are well known in the art. To avoid that the figures would unnecessarily become very complicated, these delay means have not been shown in the figures and have not been described explicitly.

The invention claimed is:

1. Circuit arrangement for igniting and operating a lamp comprising input terminals for connection to a supply voltage source, a DC-AC-converter coupled to the input terminals and equipped with a series arrangement comprising a first and a second switching element and connecting the input terminals, a control circuit, coupled to respective control electrodes of the first switching element and the second switching element, for generating a periodic control signal for alternately rendering the first switching element and the second switching element conductive and non-conductive, a load circuit shunting one of the switching elements and comprising a series arrangement of an inductive element and a first capacitive element, characterized in that the control circuit is equipped with a first signal generator coupled to one of the switching elements for generating a first signal that represents the integral of a current that has flowed in forward direction through said switching element in the present period of the control signal, a second signal generator coupled to the first singal generator for generating a first reference signal that represents a desired value of the integral of the current flowing in forward direction through said switching element in each period of the control signal, a switching circuit coupled to the first signal generator, to the second signal generator and to a control electrode of the switching element coupled to the first signal generator, for rendering the switching element non-conductive, when the first signal equals the first reference signal.

2. Circuit arrangement as claimed in claim 1, wherein the first signal generator comprises an impedance in series with the switching element that the first signal generator is coupled to, a third signal generator for generating a second reference signal, an integrator having a first input terminal coupled to the impedance and a second input terminal coupled to an output of the third signal generator for integrating a voltage difference between the first and second input terminals while this voltage difference is positive.

3. Circuit arrangement as claimed in claim 2, wherein the voltage difference between the first and second input terminals of the integrator equals a voltage across the impedance.

4. Circuit arrangement as claimed in claim 2, wherein the integrator comprises a transductance amplifier, equipped with two input terminals and an output terminal, for generating an output current proportional to a voltage difference between its input terminals and comprises a second capacitive element coupled to the output terminal of the transductance amplifier.

5. Circuit arrangement as claimed in claim 2, wherein the third signal generator comprises a diode and a second capacitive element and the integrator comprises an ohmic resistor and the second capacitive element.

6. Circuit arrangement as claimed in claim 1, wherein the control circuit further comprises a timing circuit coupled to the switching circuit for rendering the switching element coupled to the first signal generator non-conductive after it has been conductive during a predetermined time interval.

7. Circuit arrangement as claimed in claim 6, wherein the timing circuit comprises a current source and a timing capacitor.

8. Circuit arrangement as claimed in claim 4 including a timing circuit comprising a current source and a timing capacitor, wherein the timing capacitor is formed by the second capacitive element.

9. Circuit arrangement as claimed in claim 2, wherein the voltage difference between the first and the second input terminal equals the voltage across the impedance minus the second reference voltage.

10. Circuit arrangement as claimed in claim 4, wherein the transductance amplifier comprises two current mirrors and an ohmic resistor.

* * * * *